United States Patent [19]

Antonelli

[11] Patent Number: 5,058,783

[45] Date of Patent: Oct. 22, 1991

[54] SPRAY TUBE SUPPORT ASSEMBLY

[76] Inventor: Ken Antonelli, 10039 Concord Ct., Parma Heights, Ohio 44130

[21] Appl. No.: 482,641

[22] Filed: Feb. 21, 1990

[51] Int. Cl.[5] ..... B67D 3/00

[52] U.S. Cl. ..... 222/538; 222/530; 222/543

[58] Field of Search ..... 222/530, 538, 543, 402.1; 239/282

[56] References Cited

U.S. PATENT DOCUMENTS

| | | | |
|---|---|---|---|
| D. 266,017 | 8/1982 | Kellogg . | |
| 925,870 | 6/1909 | Cowgill | 222/543 |
| 1,329,184 | 1/1920 | Hyams . | |
| 1,343,921 | 6/1920 | Klingman . | |
| 1,411,573 | 4/1922 | McGarrahan . | |
| 1,600,379 | 9/1926 | Werneman . | |
| 2,741,406 | 4/1956 | Matson . | |
| 2,939,671 | 6/1960 | Beekman . | |
| 3,116,856 | 1/1964 | Prussin et al. . | |
| 3,137,417 | 6/1964 | Zetterstrom . | |
| 3,148,806 | 9/1964 | Meshberg . | |
| 3,160,333 | 12/1964 | Budrow | 222/530 |
| 4,096,974 | 6/1978 | Haber et al. . | |
| 4,305,528 | 12/1981 | Craig . | |
| 4,520,951 | 6/1985 | Facey . | |
| 4,664,300 | 5/1987 | Strickland . | |
| 4,664,301 | 5/1987 | Hoyt . | |
| 4,728,007 | 3/1988 | Samuelson et al. . | |
| 4,819,838 | 4/1989 | Hart, Jr. . | |
| 4,858,792 | 8/1989 | de Laforcade . | |

FOREIGN PATENT DOCUMENTS

| | | | |
|---|---|---|---|
| 141625 | 6/1949 | Australia | 222/543 |
| 1238023 | 6/1988 | Canada | 222/543 |

*Primary Examiner*—Michael S. Huppert
*Assistant Examiner*—Gregory L. Huson
*Attorney, Agent, or Firm*—Fay, Sharpe, Beall, Fagan, Minnich & McKee

[57] ABSTRACT

A spray container having a spray nozzle unit for outward discharge of fluid from the spray container often includes an elongated spray tube having a size and shape adapted for mounting onto the spray nozzle unit for guiding a spray of fluid discharged from the spray container. A spray tube support construction for use with the container retains the spray tube adjacent the container. The support construction includes a support body and a holding element for holding the spray tube. A seucring element affixes the support body to the spray container and a connecting element affixes the holding element, and hence the spray tube, to the support body.

20 Claims, 1 Drawing Sheet

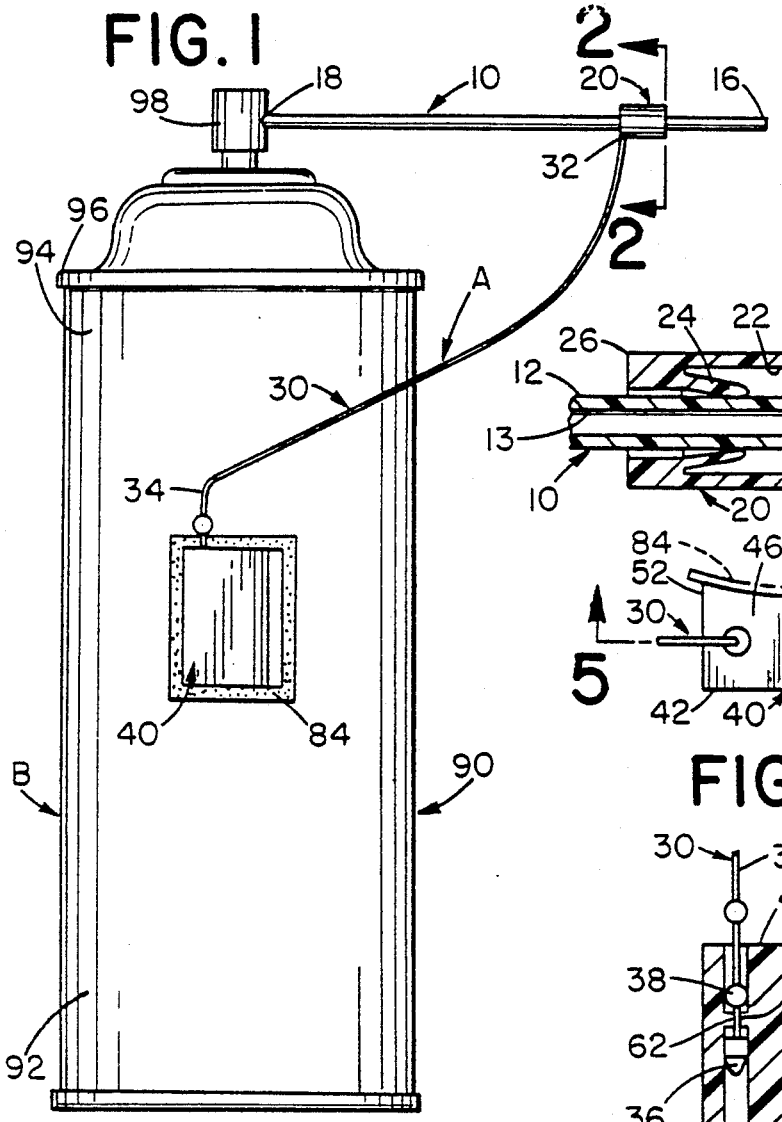
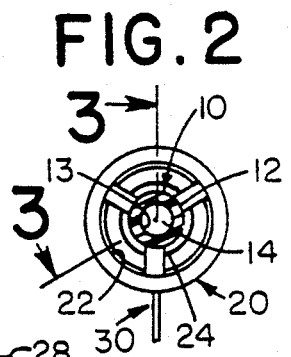
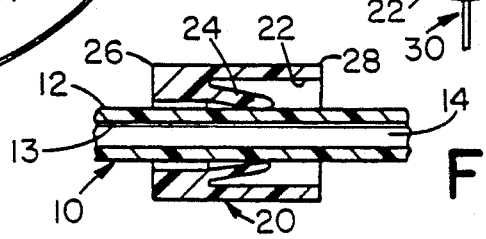
FIG. 3
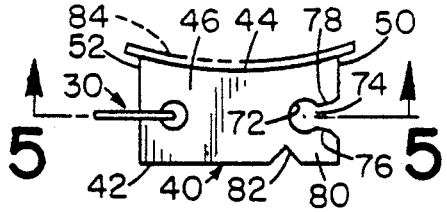
FIG. 4
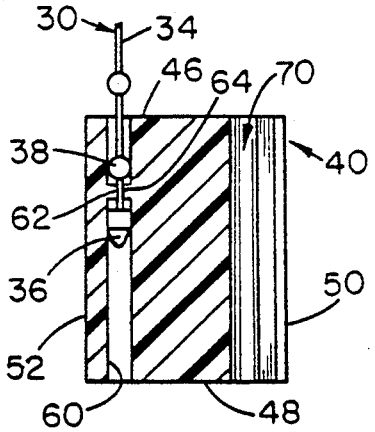
FIG. 5
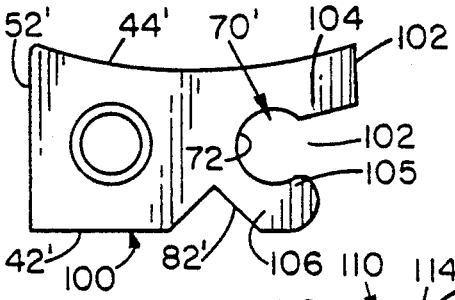
FIG. 6
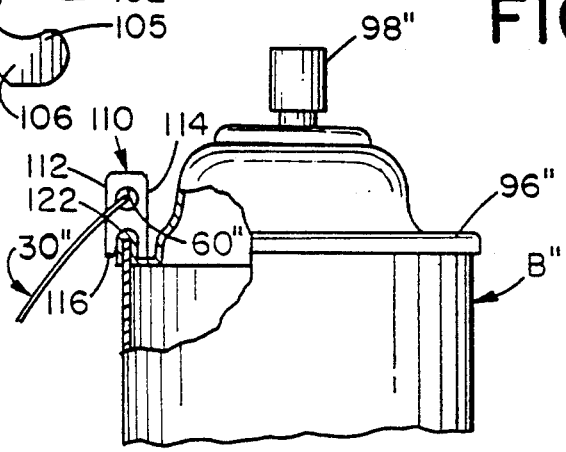
FIG. 7

SPRAY TUBE SUPPORT ASSEMBLY

BACKGROUND OF THE INVENTION

This invention relates generally to aerosol-type spray cans which utilize a dispensing or spray tube. More specifically, the present invention relates to a support assembly for securing such a spray tube to an aerosol spray can.

Aerosol-type spray cans are in wide use today for dispensing many types of fluids ranging from paint to lubricants to insecticides to cleaning solutions. Spray cans generally incorporate a gas under pressure for ejecting the fluid contents of the can in the form of a spray through an upper discharge nozzle. While sometimes a broad spray pattern for the fluid contents is acceptable, often an accurate narrow spray pattern is necessary.

To assist with the application of some products which require accurate spraying, it has been known to provide a small bore tube, commonly of a flexible plastic material, which has one end inserted into the outlet of the aerosol valve so that the aerosol product may be applied through the tube. Such tubes have been fastened to the aerosol can for sale by way of adhesive tape or by a rubber band. When use is desired, the spray tube is removed from the container and one end of the spray tube is seated within a nozzle discharge port for in-line guided passage of the sprayed fluid to a specific location as a discrete, thin, liquid stream. After use, the spray tube is preferably removed from the spray nozzle unit and is reattached to the spray container for storage so that it is ready for subsequent use.

Unfortunately, in many instances, the spray tube is intentionally or negligently not reattached to the spray container. In some instances, reattachment becomes impossible due to the failure of the adhesive tape to stick to the container or a breaking of the rubber band previously used to hold the tube to the container. In other instances, it is necessary for the user to disconnect the tube so that the normal nozzle spray pattern can be utilized for large area surfaces to be treated. However, as the user will often simply place the tube on a work bench or some other surface, it frequently becomes lost. While it is possible to provide a flexible hose permanently connected to the discharge nozzle of a can, such a feature renders the spray can useless for conventional-type spraying operations wherein a very wide spray pattern may be desired.

It is also known that a retaining means can be molded into the upright side of a cap for an aerosol container so that the tube may be held in the retaining means when not in use. Such caps have to be of a diameter substantially as large as the diameter of the aerosol can so that the tube may be fixed in an upright position on the outer periphery of the cap and extend down the side of the can when packed. This arrangement has the disadvantage that a comparatively large amount of plastic material must be utilized for the cap, which needs to be of the same diameter as the can itself. That is uneconomical.

It is advantageous to use smaller caps to engage an upstanding flange surrounding the aerosol spray nozzle in order to reduce the amount of plastic material required. However, such caps are not suitable for the mounting of a dispensing tube. In addition, since the dispensing tube is not securely attached to the spray container, it can still be lost or misplaced after it is disconnected from the spray nozzle and before it is secured to the cap. For example, if the spray can is used for wide area spraying, after narrow area spraying, obviously the cap will not be placed back on the spray container until after such use. In the meanwhile, the spray tube may be misplaced so that when the cap is reattached, the tube is missing.

It is also known to provide an aerosol cap with a transverse groove in its top surface for retaining a dispensing tube therein. However, the length of such a dispensing tube is normally not much greater than the diameter of the cap. The dispensing tube is therefore considerably shorter than the relatively long dispensing tube that is normally necessary for access to a hard to reach area during a spraying operation.

Accordingly, it has been considered desirable to develop a new and improved spray tube support assembly which would overcome the foregoing difficulties and others while providing better and more advantageous overall results.

BRIEF SUMMARY OF THE INVENTION

In accordance with the present invention, a new and improved spray tube support assembly is provided for use with a spray container having a spray nozzle unit for outward discharge of fluid from the spray container.

More specifically in accordance with this aspect of the invention, the assembly comprises an elongated spray tube having a size and shape adapted for mounting onto the spray nozzle unit for inline passage of fluid discharged from the spray container. Also provided is a support construction for retaining the spray tube adjacent the spray container. The support construction comprises a support member, a holding means for holding the spray tube, a securing means for affixing the support body to the spray container and a connecting means for affixing the holding means, and hence the spray tube, to the support member.

In accordance with another aspect of the invention, a spray tube support assembly for use with a spray container having a spray nozzle unit for outward discharge of fluid from the spray container as provided.

More specifically in accordance with this aspect of the invention, the assembly comprises an elongated spray tube having a size and shape adapted for mounting onto the spray nozzle unit for inline passage of fluid discharged from the spray container and a support construction for the spray tube. The support construction comprises a support body, a securing means provided on the body for affixing the support member to the spray container and a tubular member having a longitudinally extending centrally disposed aperture through which the spray tube can extend. Also provided is a connecting cord having a first end secured to the body and a second end secured to the tubular member.

According to still another aspect of the invention, a holder is provided for an elongated spray tube which is selectively mountable onto a spray nozzle of a spray can containing fluid under pressure.

More particularly in accordance with this aspect of the invention, the holder comprises a support construction for retaining the spray tube adjacent the spray can. The support construction comprises a support body and a first securing means provided on the support body for affixing the support member to the spray container. Further provided is a holder for the spray tube. The holder comprises a tubular member, having a longitudinally extending centrally disposed aperture through which the spray tube can extend, and a second securing means, provided in the tubular member aperture, for retarding a removal of the spray tube from the tubular member. Also provided is a connecting member for connecting the holder to the body.

One advantage of the present invention is the provision of a new and improved spray tube securing means for affixing a spray tube to a spray container.

Another advantage of the present invention is the provision of a spray tube support assembly which includes a flexible connecting means for permanently, yet flexibly, securing the spray tube to the spray container.

Still another advantage of the present invention is the provision of a support construction for retaining a spray tube adjacent a spray container. The support construction includes a support body and a securing means for affixing the support body to the spray container.

Yet another advantage of the present invention is the provision of a spray tube support construction which includes a holding means for the spray tube, with the connecting means being secured to the holding means.

A further advantage of the present invention is the provision of a spray tube support construction which includes a clip means provided on the support body for securing the spray tube to the support body in a storage position relative to the spray container.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof, and wherein:

FIG. 1 is a side elevational view of a support construction for securing a spray tube to a spray container according to a preferred embodiment of the present invention;

FIG. 2 is an enlarged cross-sectional view of a spray tube and a holding means therefor along line 2—2 of FIG. 1;

FIG. 3 is an enlarged side elevational view through FIG. 2 along line 3—3;

FIG. 4 is an enlarged end elevational view of a support member and a connecting means of the support construction of FIG. 1;

FIG. 5 is a cross-sectional view of the support member and connecting means of FIG. 4 along line 5—5;

FIG. 6 is an end elevational view of a support member according to a first alternate embodiment of the present invention; and, FIG. 7 is a side elevational view, partially broken away, of a support member according to a second alternate embodiment of the present invention as it is utilized to hold a spray tube on a rim of a spray container.

DETAILED DESCRIPTION OF PREFERRED AND ALTERNATE EMBODIMENTS

Referring now to the drawings wherein the showings are for purposes of illustrating preferred and alternate embodiments of the invention only and not for purposes of limiting same, FIG. 1 shows the subject new spray tube support assembly A being utilized to secure a spray tube 10 to a spray container B. While the support assembly A is primarily designed for and will hereinafter be described as being utilized on a particular kind of spray container, such as a container of lubricant, it should be recognized that the support assembly could also be utilized on many different varieties of aerosol containers.

The support assembly A is used to hold the tube 10, which, as shown in FIG. 2, has an outer periphery 12 and an inner periphery 13 defining a bore 14 which extends along the longitudinal axis of the tube from a first end 16 to a second end 18. The tube 10 is held in a holding means 20 which is preferably also tubular and has a longitudinally extending through bore 22 with an inner diameter that is larger than the outer diameter of the tube in order to allow the tube to be slipped thereinto. As best shown in FIG. 3, one or more fingers 24 extend into the bore 22 of the holder 20 and resiliently bias the tube 10 towards the center of the holder. The fingers 24 are preferably all angled in the same direction so that while the tube 10 can be held when it is slipped in through a first end 26 of the holder 20, it cannot be held when it is slipped in through a second end 28 of the holder. Since the fingers 24 are resilient, they can flex the amount necessary to accommodate a variety of tubes having different diameters. It is noted in this regard that the largest diameter spray tube may be one and one half times as large in diameter as the smallest diameter spray tube.

With reference now, again, to FIG. 1, a connector cord 30 is suitably attached at a first end 32 to the first end 28 of the tubular holder 20. As shown in FIG. 5, a second end 34 of the connector cord 30 has at least two enlarged sections as at 36 and 38. The first enlarged section 36 is pointed and the second section 38 may be circular. Preferably, the two sections are spaced from each other. They are held in a support member or block 40 that is preferably substantially rectangular as shown in FIG. 5. With reference now also to FIG. 4, the block 40 includes a flat side wall 42 and opposite thereto a curved side wall 44 which is preferably concave. Also provided is a first end wall 46 and a second end wall 48 (FIG. 5) as well as first and second side walls 50 and 52. While a rectangular block is illustrated, it can be appreciated that blocks having other geometric configurations could also be used.

A bore 60 extends through the block from the first end wall 46 to the second end wall 48. The bore 60 is of a suitable diameter so as to accommodate the enlarged sections 36 and 38. Protruding into the bore 60 are a pair of facing flanges 62 and 64 which allow the enlarged end 36 of the connector cord 30 to slide thereinto due to the resilience of the flanges and of the end 36, and will then lock the cord in place to prevent a sliding out of this end. In other words, the flanges 62 and 64 will extend into the reduced diameter area between the pointed section 36 and the circular section 38 in order to restrict the range of longitudinal movement of the connector cord 30 in 10 the bore 60.

Provided on the flat end wall 50 of the block 40 is a longitudinally extending slot 70 which can serve as a clip means for securing the spray tube to the support member in a storage position relative to the spray container B. The slot 70 preferably includes a somewhat circular housing portion 72 in which the tube 10 is adapted to seat as well as an entry aperture 74 defined by a pair of spaced lips 76 and 78 which are provided in the block.

An arm 80 is defined on the block 40 between the slot 70 and a groove 82 on the face 42. The groove 82 extends parallel to the slot 70. This enables the arm to be flexible and easily moved when the tube 10 is snapped into place on the block 40 or removed therefrom.

In the preferred embodiment, the holder 20, connector cord 30 and support block 40 are all made of a suitable conventional resilient plastic material, such as polyethylene or the like. The holder 20 and cord 30 can be integrally formed from a single type of plastic material and the block 40 can be separately manufactured from the same, or another material.

Preferably a securing means is provided for affixing the support member or block 40 to the spray container B. In one embodiment, the securing means comprises a strip of two-sided adhesive tape 84 which is secured on the curved side wall 44 of the block 40. Of course a layer of self-stick adhesive could also be utilized instead of two-sided tape if desired.

With reference now again to FIG. 1, the spray container B includes a substantially cylindrical body 90 having an outer periphery 92 to which the adhesive tape 84 secures the block 40. The block curved or concave wall 44 preferably is a section of a circle having a diameter such that it equals the diameter of the spray can. This insures that the block wall 44 and the can outer periphery 92 mate so that the adhesive tape 84 can securely hold the block 40 to the can body 90. Also provided on the spray container B is an upper end 94 which is defined by a rim 96. A spray nozzle 98 surmounts the container B to allow the spraying of the can's contents.

In the use position, the tube 10 has its second end 18 secured in the spray nozzle 98 of the container B in order to direct the fluid spray thereof through its first end 16. A central portion of the tube 10 is held within the holder 20 while the holder is, in turn, connected by the connector cord 30 to the block 40. The block is secured by the adhesive tape 84 to the can outer periphery 92. In this way, if and when the tube becomes detached from the spray nozzle 98, it will still be securely held to the can due to the cooperation of the tubular holder 20, the connector cord 30 and the block 40.

When it is desired to stow the tube in a storage position, it can be clipped to the block 40 by use of the slot 70 therein. This may become necessary either when it is desired to use a broad spray pattern from the container B or during a storage condition of the container when it may also be desired to reseat a cap (not illustrated) on the container.

With reference now to FIG. 6, a first alternate embodiment of a support assembly for a spray tube is there illustrated. For ease of illustration and appreciation of this alternative, like components will be identified by like numerals with a primed suffix (') and new components will be identified by new numerals.

A support member or block 100 includes a flat side wall 42' and opposite thereto a concave curved side wall 44'. Also provided are a first end wall 102 and a second end wall 52'.

Provided on the flat end wall 102 of the block 40' is a longitudinally extending slot 70' which can serve as a clip means for securing the spray tube to the support member in the storage position relative to the spray container. The slot 70' preferably includes a somewhat circular housing portion 72' in which a tube (not illustrated) is adapted to seat as well as an entry aperture 102 defined by a pair of spaced lips 104 and 105 which are provided on the block. An arm 106 is defined on the block 40' between the slot 70' and a groove 82' on the face 42'. The groove 82' extends parallel to the slot 70. However, the arm 106 is shorter than the corresponding arm 80 provided in the embodiment illustrated in FIG. 4. This makes it easier to snap a tube into and out of the groove 82'. However, the lips 104 and 105 still securely hold the tube in place in the block 100.

With reference now to FIG. 7, a second alternate embodiment of a support assembly for a spray tube is there illustrated. For ease of illustration and appreciation of this alternative, like components will be identified by like numerals with a double primed suffix (") and new components will be identified by new numerals.

A support member or block 110 is used to hold a spray tube to a container B". The block is substantially rectangular in form and includes first and second side walls 112, 114, both of which can be flat or straight. The block 110 further includes first and second end walls, only one of which, at 116, is visible. Extending longitudinally through the block 110 is a bore 60" which is adapted to hold an enlarged end of a connector cord 30". Extending longitudinally along the block first end 116 is clip means formed by a slot 122 which, as in the embodiment of FIG. 3, includes a somewhat circular housing portion and adjacent thereto an opening defined by a pair of spaced lips.

In this embodiment of the invention, the block 110 is adapted to be seated on a raised rim 96" of the spray container B" instead of to its side wall. Thus the slot cooperates with the rim 96" instead of the tube. The clip means serves as the securing means for securing the block 110 to the container B'. Through the cooperation of a connector cord 30" with a suitable tubular holder (not illustrated) through which a tube (not illustrated) extends, the support assembly will maintain the tube, when not secured to a spray nozzle 98" or not in use, adjacent the can B". However, in this embodiment the tube is not itself clipped to the block 110, but simply hangs from the block, and the can, by the connector cord 30". The clip means can selectively secure the block 110 on the rim 96' so that the block can be removed from the can or moved around the periphery of the can if necessary.

The invention has been described with reference to preferred and alternate embodiments. Obviously, modifications and alterations will occur to others upon the reading and understanding of this specification. It is intended to include all such modifications and alterations insofar as they come within the scope of the appended claims or the equivalents thereof.

Having thus described the invention, it is now claimed:

1. A spray tube support assembly for use with a spray container having a spray nozzle unit for outward discharge of fluid from the spray container, comprising:

an elongated spray tube having a size and shape adapted for mounting onto the spray nozzle unit for in-line passage of fluid discharged from the spray container; and, a support construction for retaining said spray tube adjacent the spray container, said support construction comprising:

a support member, a holding means for holding said spray tube, a securing means for affixing said support member to the spray container, and an elongated flexible tether for affixing said holding means, and hence said spray tube, to said support member.

2. The assembly of claim 1 wherein said securing means comprises a resilient clip assembly provided on said support member, said clip assembly being adapted to selectively engage a raised rim located on an upper end of the spray container.

3. The assembly of claim 1 wherein said tether comprises a strand of material having a first end secured to said holding means and a second end operatively connected to said support member.

4. The assembly of claim 1 wherein said support member comprises a body having at least one wall and wherein said securing means comprises an adhesive layer provided on said at least one wall of said body.

5. The assembly of claim 4 wherein said support construction further comprises a clip means provided on said support member for securing said spray tube to said support member in a storage position relative to the spray container.

6. The assembly of claim 1 wherein said holding means comprises a tubular body having a centrally disposed longitudinally extending aperture through which said elongated spray tube can extend.

7. The assembly of claim 6 wherein said holding means further comprises at least one resilient finger extending into said tubular body aperture in order to exert a force against said spray tube thereby hindering said spray tube's removal from the tubular body.

8. A spray tube support assembly for use with a spray container having a spray nozzle unit for outward discharge of fluid from the spray container, comprising:

an elongated spray tube having a size and shape adapted for mounting onto the spray nozzle unit for in-line passage of fluid discharged from the spray container; and, a support construction for said spay tube, said support construction comprising:

a support body, a securing means provided on said body for affixing said support body to the spray container, a tube holding member having a longitudinally extending aperture through which said spray tube can extend, wherein said spray tube can be longitudinally moved in relation to said tube holding member, and a connecting cord having a first end secured to said body and a second end secured to said tube holding member.

9. The assembly of claim 8 wherein said tube holding member is tubular in cross section such that said aperture is centrally located and extends longitudinally therethrough and wherein said member further comprises at least one resilient finger extending into said centrally located aperture to exert a force against said spray tube thereby hindering said spray tube's removal from said member.

10. The assembly of claim 8 wherein said body, tube holding member and connecting cord are made of a plastic material.

11. The assembly of claim 8 wherein said support construction further comprises a clip means provided on said support body for securing said spray tube to said support body in a storage position relative to the spray container.

12. The assembly of claim 8 wherein said securing means comprises a resilient clip assembly provided on said body, said clip assembly being adapted to selectively engage a raised rim located on an upper end of the spray container to hold said body on the spray container.

13. The assembly of claim 8 wherein said securing means comprises an adhesive layer provided on one wall of said body, said adhesive layer being adapted to secure said body to an outer periphery of the spray container.

14. The assembly of claim 13 wherein said body is substantially rectangular in outline, and said one wall of said body is concave.

15. The assembly of claim 8 wherein said connecting cord second end is provided with at least one enlarged section and wherein said support body includes a bore into which said cord second end is adapted to extend.

16. The assembly of claim 15 wherein said support body includes a means for preventing a removal of said cord second end from said bore.

17. A holder for a spray tube of a spray can containing fluid under pressure, comprising:

an elongated spray tube which is selectively mountable onto a spray nozzle of the spray can; and, a support construction for retaining said spray tube adjacent the spray can, said support construction comprising:

a support body, a first securing means provided on said body for affixing said support body to the spray container, a holder for said spray tube, said holder comprising:

a tubular member having a longitudinally extending centrally disposed aperture through which said spray tube can extend, and a second securing means provided in said tubular member aperture for retarding a removal of said spray tube from said tubular member, and an elongated flexible tether for connecting said holder to said body.

18. The holder of claim 17 wherein said first securing means comprises a clip assembly provided on said body, said clip assembly being adapted for engaging a raised rim located on the spray container to hold said body on the spray container.

19. The holder of claim 17 wherein said first securing means comprises an adhesive layer provided on one wall of said body, said adhesive layer being adapted to 20. The holder of claim 19 wherein said body one Wall has a curved surface With a curvature of a diameter Which approximates a diameter of the spray container.

* * * * *